US006873105B2

(12) United States Patent
Akiba

(10) Patent No.: US 6,873,105 B2
(45) Date of Patent: Mar. 29, 2005

(54) PLASMA DISPLAY PANEL WITH METAL BARRIER PLATES WITH PROJECTIONS

(75) Inventor: Yutaka Akiba, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/084,793

(22) Filed: Feb. 25, 2002

(65) Prior Publication Data

US 2002/0145387 A1 Oct. 10, 2002

(30) Foreign Application Priority Data

Apr. 9, 2001 (JP) ..... 2001-109972

(51) Int. Cl.[7] ..... H01J 11/02; H01J 17/49

(52) U.S. Cl. ..... 313/586; 313/584; 313/585; 313/587; 345/60

(58) Field of Search ..... 313/491–493, 313/581–587, 590, 309; 315/169.4; 345/37, 41, 55, 60

(56) References Cited

U.S. PATENT DOCUMENTS

| | | | | | |
|---|---|---|---|---|---|
| 4,853,590 | A | * | 8/1989 | Andreadakis | 313/485 |
| 5,264,758 | A | | 11/1993 | Iijima et al. | |
| 5,371,437 | A | * | 12/1994 | Amano | 315/169.1 |
| 5,383,040 | A | * | 1/1995 | Kim | 349/32 |
| 5,587,624 | A | * | 12/1996 | Komaki | 313/584 |
| 5,663,611 | A | * | 9/1997 | Seats et al. | 313/584 |
| 5,684,361 | A | * | 11/1997 | Seki | 313/582 |
| 5,744,909 | A | * | 4/1998 | Amano | 313/585 |
| 5,808,408 | A | * | 9/1998 | Nakamoto | 313/484 |
| 5,939,828 | A | * | 8/1999 | Matsuzaki et al. | 313/584 |
| 5,962,974 | A | * | 10/1999 | Komaki et al. | 313/582 |
| 6,140,774 | A | * | 10/2000 | Mori et al. | 315/169.4 |
| 6,172,461 | B1 | * | 1/2001 | Ha | 313/585 |
| 6,414,435 | B1 | * | 7/2002 | Akiba | 313/584 |
| 6,436,788 | B1 | * | 8/2002 | Lee et al. | 438/414 |
| 2002/0008474 | A1 | | 1/2002 | Kurogi et al. | |

FOREIGN PATENT DOCUMENTS

| | | |
|---|---|---|
| JP | 10-241577 | 9/1998 |
| JP | 11-086737 | 3/1999 |
| JP | 11-312470 | 11/1999 |
| JP | 2000-223035 | 8/2000 |
| JP | 2000-306516 | 11/2000 |
| JP | 2001-084913 | 3/2001 |
| JP | 2001-266751 | 9/2001 |
| JP | 2001-266799 | 9/2001 |

* cited by examiner

*Primary Examiner*—Ashok Patel
(74) *Attorney, Agent, or Firm*—Townsend and Townsend and Crew LLP

(57) ABSTRACT

The invention provides plasma display panel technique that is operated with a low voltage and reduced power consumption, and exhibits high luminous efficiency and high luminance. A barrier plate comprises a metal electrode having a projection that projects partially toward the cell space side between display electrodes formed so that the display electrodes intersect with an address electrode in a plane approximately parallel to the panel plane.

16 Claims, 8 Drawing Sheets

PLASMA DISPLAY PANEL WITH METAL BARRIER PLATES WITH PROJECTIONS

CROSS REFERENCE TO RELATED APPLICATION

This application is related to and claims priority from Japanese Patent Application No. 2001-109972, filing date Apr. 9, 2001.

FIELD OF THE INVENTION

This invention relates to a plasma display panel, and more particularly relates to a structure having barrier plate including a metal electrode around a cell. Furthermore, this invention relates to an image display apparatus having a plasma display panel.

BACKGROUND OF THE INVENTION

For example, Japanese Unexamined Patent Publication No. Hei 11-312470 and Japanese Unexamined Patent Publication No. 2000-306516 disclose the plasma display panel technique having a barrier plate including a metal electrode around a cell. Japanese Unexamined Patent Publication No. Hei 11-312470 discloses the structure in which X electrode of the display electrode is disposed on the front substrate side and Y electrode of the display electrode is disposed on the back substrate side, a barrier plate including lattice-like metal electrode formed so as to surround a cell is disposed between both electrodes, and an I-shaped discharge passage is formed between the X electrode and Y electrode. Japanese Unexamined Patent Publication No. 2000-306516 discloses a structure in which X electrode and Y electrode are both disposed on the back substrate side, a barrier plate including a metal plate and a partition wall are disposed between the front substrate side and the back substrate side, and a reversed U-shaped discharge passage is formed between the X electrode and Y electrode.

It is desired that sustain pulse voltage for display discharging is reduced to a lower value and the discharge energy is controlled properly to improve the luminous efficiency and the luminance for the above-mentioned prior art.

The present invention has been accomplished in view of the prior art involved in the above-mentioned problem, and the subject to be solved by the present invention includes (1) the lower sustain pulse voltage for display discharge, (2) improved luminous efficiency and luminance with the certain predetermined power consumption, and (3) simple structure for realizing the above-mentioned (1) and (2).

The object of the present invention is to provide a technique that solves the above-mentioned problem.

SUMMARY OF THE INVENTION

To solve the above-mentioned problem, the present invention provides plasma display panels as described herein under.

(1) A plasma display panel provided with a barrier plate including a metal electrode disposed between the first and second display electrodes that are formed so as to intersect with the address electrode, wherein the metal electrode has projections (corresponding example, characters 30, 30', 31, and 32) that project to the cell space side partially in a plane approximately parallel to the panel plane.

(2) The plasma display panel provided with a barrier plate including a lattice-like metal electrode disposed between the first and second display electrodes that are formed so as to intersect with the address electrode, wherein the metal electrode has projections that project toward the cell space side partially in a plane approximately parallel to the lattice plane so as to face each other with interposition of the middle of a cell.

(3) The plasma display panel provided with a barrier plate including a lattice-like metal electrode disposed between the first and second display electrodes that are formed so as to intersect with the address electrode, wherein the metal electrode has a projection that projects toward the cell space side partially at the position where the metal electrode overlaps flat with any one of the first display electrode and the second display electrode.

(4) The plasma display panel provided with a barrier plate including a metal electrode disposed between the first and second display electrodes that are formed so as to intersect with the address electrode orthogonally, wherein the metal electrode has projections that project toward the cell space side partially on the first portion where the metal electrode overlaps flat with the first display electrode and on the second portion where the metal electrode overlaps flat with the second display electrode.

(5) The projections are formed so as to face each other in (1), (3), or (4).

(6) An image display apparatus is provided with any one of plasma display panels described in (1) to (5) for displaying an image by driving the plasma display panel based on the image signal.

DETAILED DESCRIPTION OF THE PREFERRED EMBODIMENTS

Embodiments of the present invention will be described in detail hereinafter with reference to the drawings.

FIG. 1 to FIG. 4 are diagrams for describing the first embodiment of the present invention.

Figure 1:
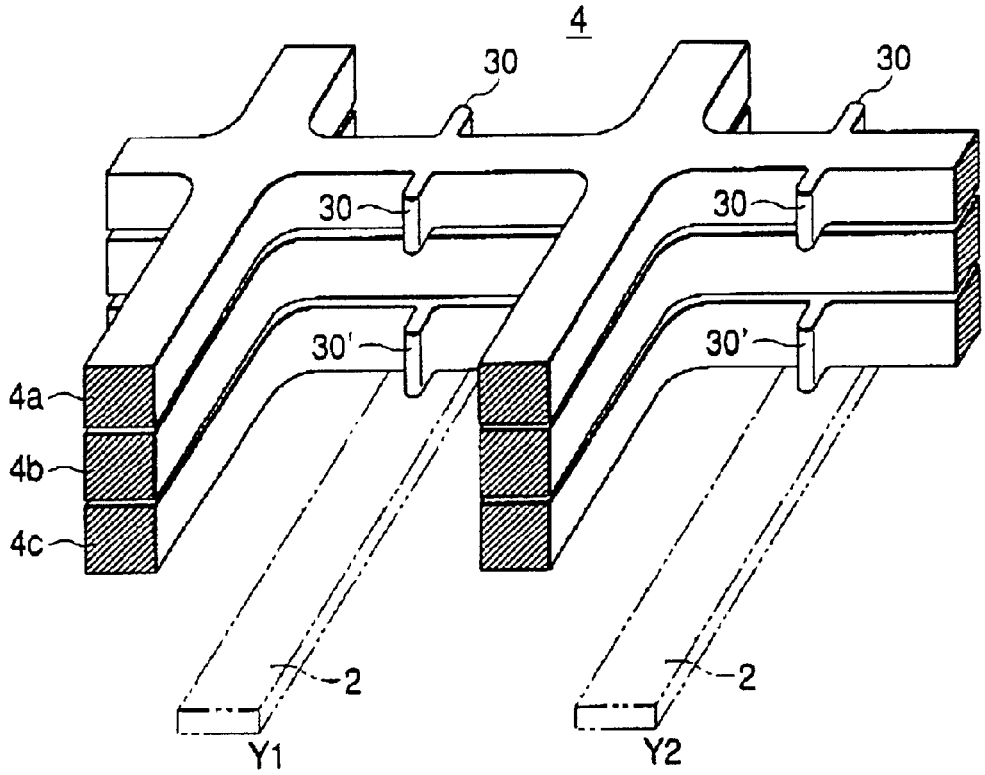
FIG. 1 is a perspective view of an exemplary structure of a metal electrode used in the first example of the present invention.
Figure 2:
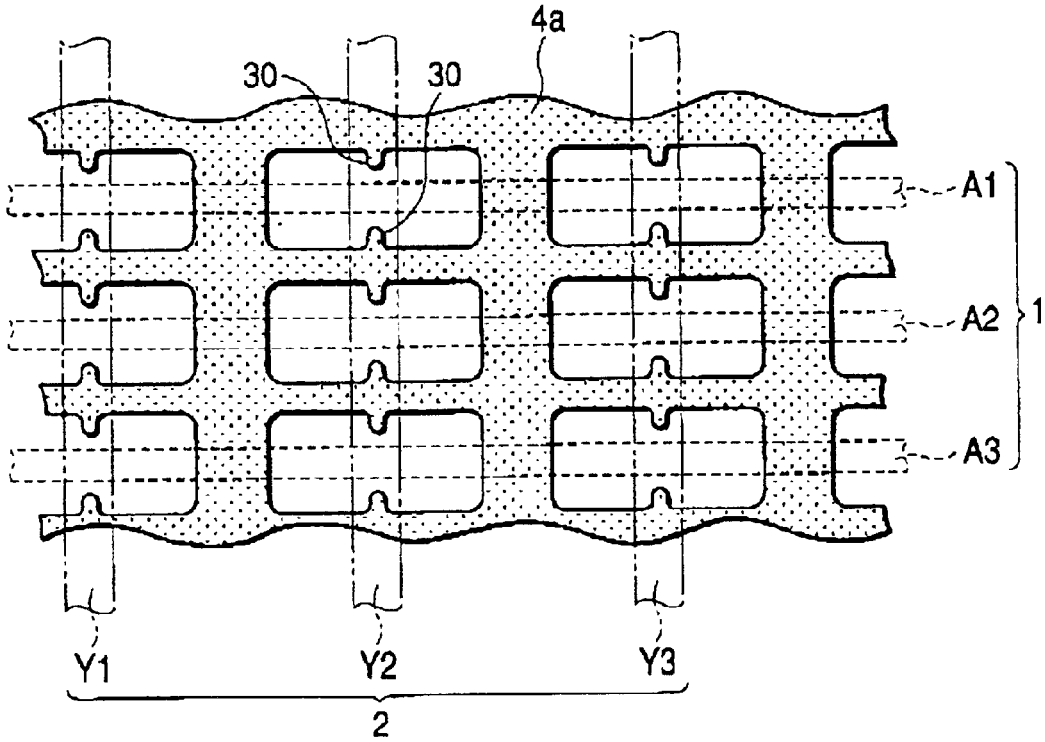
FIG. 2 is a plan view of a metal sheet that is a component of the metal electrode shown in FIG. 1.
Figure 3A:
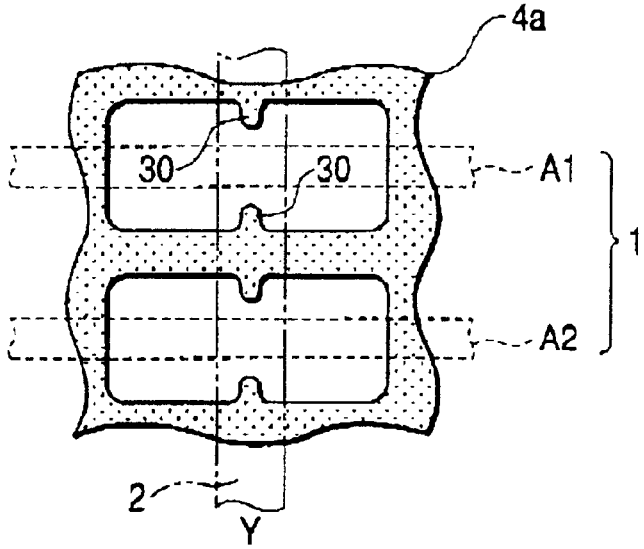
FIG. 3A to FIG. 3C are plan views of three metal sheets that are components of the metal electrode shown in FIG. 1.
Figure 3B:
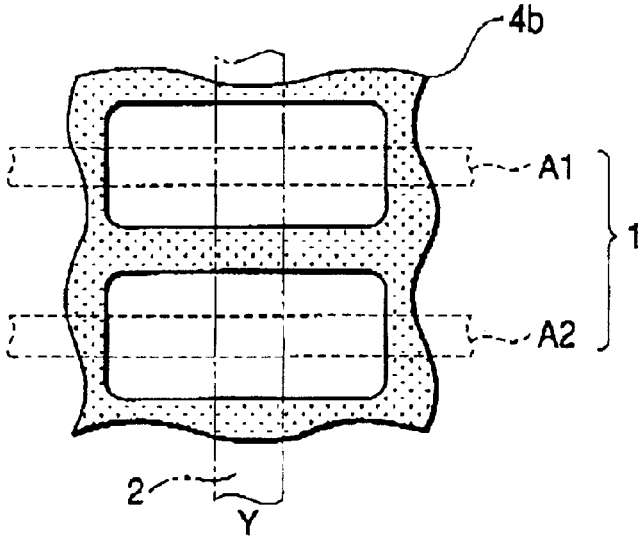
Figure 3C:
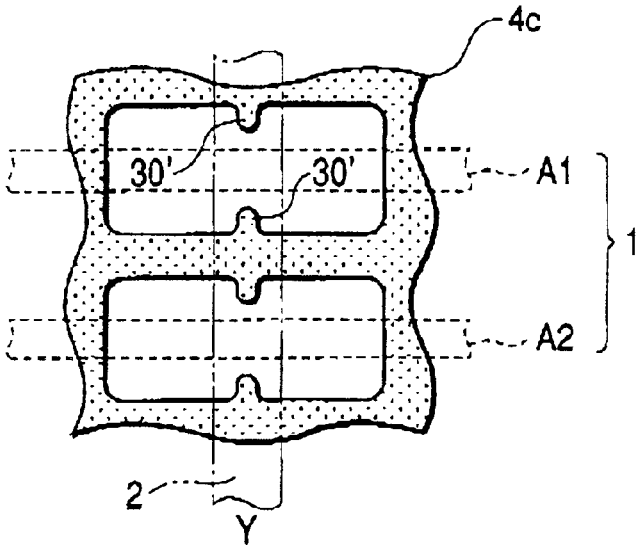
Figure 4:
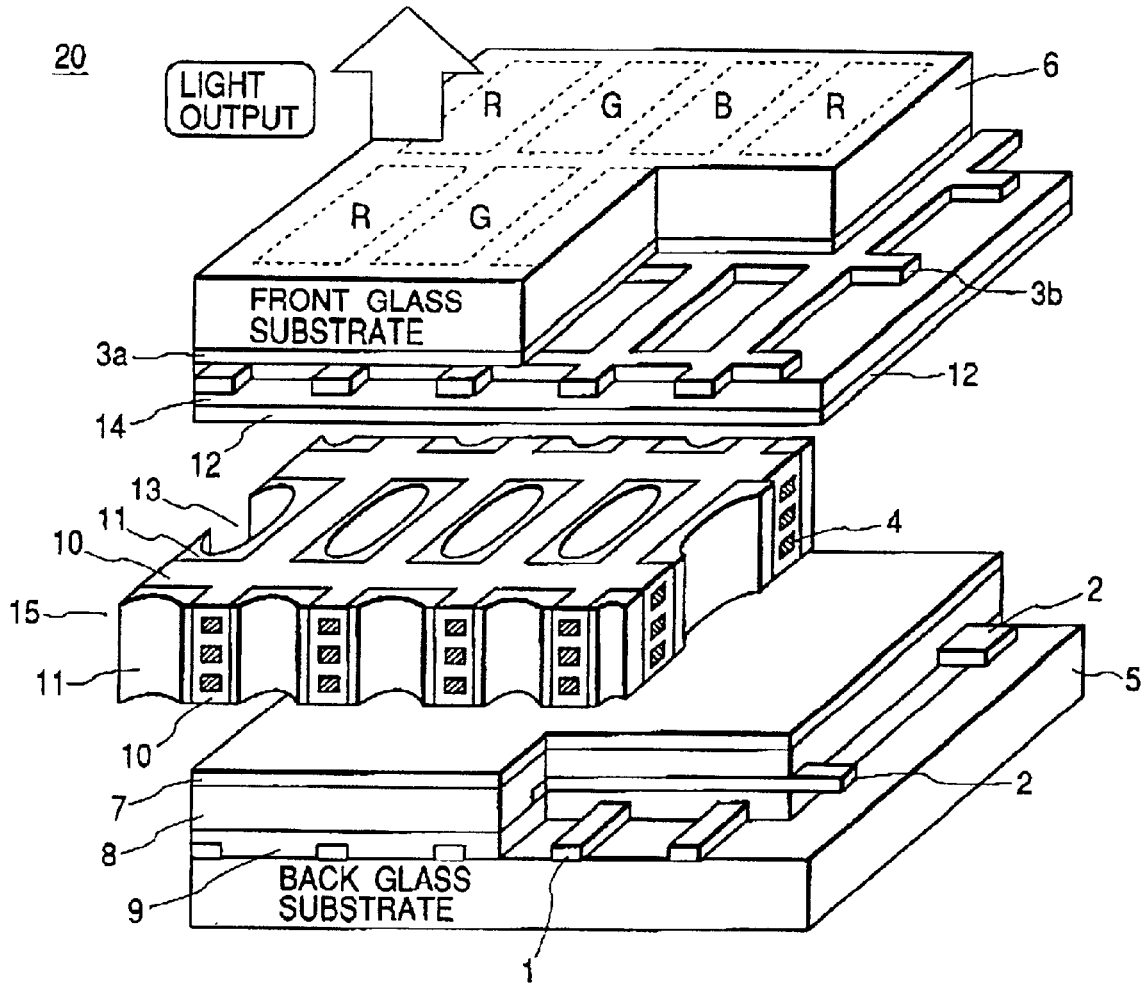
FIG. 4 is a diagram showing an exemplary structure of a plasma display panel in accordance with the first example of the present invention.

FIG. 1 is a perspective view of a metal electrode, FIG. 2 and FIG. 3 are plan views of metal sheets of the metal electrode, and FIG. 4 is a perspective view of a plasma display panel.

The present embodiment shows an example having the structure in which X electrode of the display electrode is disposed on the front substrate side and Y electrode of the display electrode is disposed on the back substrate side, a barrier plate including a lattice-like electrode comprising three metal sheets is disposed between both electrodes, and an I-shaped discharge passage is formed between the X electrode and Y electrode.

In FIG. 4, 1 denotes an address electrode for addressing, 2 denotes a first display electrode (Y electrode) for displaying disposed approximately orthogonally to the address electrode 1, 3*a* denote a flat electrode formed flat consisting of light transmissible material that is a part of the second display electrode (X electrode) for displaying together with the first display electrode 2, 3*b* denotes a bus electrode formed lattice like so as to have a portion approximately parallel to the first display electrode 2 that is a part of a second display electrode (X electrode) for displaying together with the first display electrode 2 in the same manner as in the case of the flat electrode 3*a*, 15 denotes a barrier plate having the lattice like structure disposed between the flat surface of the first display electrode (Y electrode) 2 and the flat surface of the second display electrodes (X electrode) 3*a* and 3*b*, 4 denotes a metal electrode disposed in the barrier plate 15, 5 denotes a back glass substrate, 6 denotes a front glass substrate, 8, 9, 10, and 14 denote dielectric layers, 11 denotes a fluorescent layer, 7 and 12 are protection layers consisting of MgO or $Y_hO_3$, and 13 denotes a display cell in which luminous gas such as NeXe is filled. The address electrode 1, the first display electrode (Y electrode) 2, and the second display electrodes (X electrode) 3*a* and 3*b* are structured so that positive or negative voltage can be applied on these components respectively, and the metal sheet of the metal electrode 4 is entirely or partially grounded so that the potential is zero. In such structure, the addressing is operated by applying voltage on the address electrode 1 and the first display electrode (Y electrode) 2 respectively, and the displaying is operated by applying voltage on the first display electrode (Y electrode) 2 and the second display electrode (X electrode) respectively.

FIG. 1 is a diagram showing an exemplary structure of the metal electrode 4 shown in FIG. 4 and that is a partially enlarged view of a lattice-like portion. Three metal sheets 4*a*, 4*b*, and 4*c* are laminated together. Projections 30 that project toward the cell space side (in the direction that is approximately parallel to the lattice plane) are formed on the metal sheet 4*a* that is located on the second display electrodes (X electrode) 3*a* and 3*b* side, and projections 30' that project toward the cell space are formed on the metal sheet 4*c* located on the first display electrode (Y electrode) side at the position where the metal sheet 4*c* overlaps on the first display electrode (Y electrode) (in the longitudinal direction of the first display electrode (Y electrode) 2). If the above-mentioned structure is employed, the projection 30 concentrates the line of electric force formed between the projection 30 and bus electrode 3*b* of the second display electrode (X electrode) when a sustain pulse is applied on the second display electrodes (X electrode) 3*a* and 3*b* to thereby intensify the line of electric force density, and the electric field intensity is increased. The increased electric field brings about easy display discharge. In detail, the electric field intensity required for display discharge can be secured at a low voltage, and the sustain pulse voltage to be applied on the second display electrode (X electrode) can be reduced resultantly. Furthermore, similarly to the above-mentioned case, the projection 30' concentrates the line of electric force formed between the first display electrode (Y electrode) 2 and the projection 30' when a sustain pulse is applied on the first display electrode (Y electrode) 2 to thereby intensify the line of electric force density, and the electric field intensity is increased resultantly. The increased electric field brings about easy display discharge. In detail, the electric field required for display discharge is secured with a low voltage, and the stain impulse voltage to be applied on the first display electrode (Y electrode) can be reduced.

FIG. 2 is a plan view of a metal sheet 4*a* out of three metal sheets 4*a*, 4*b*, and 4*c* that are components of the metal electrode shown in FIG. 1. Two projections 30 formed on the metal sheet 4*c* per one cell are disposed so as to face each other. Though not shown in FIG. 2, two projections 30' per one cell are disposed so as to face each other and located at the same vertical position as in the case of the projection 30. In FIG. 2, A1, A2, and A3 denote the address electrode 1.

FIG. 3A to FIG. 3C are plan views of the respective three metal sheets 4*a*, 4*b*, and 4*c* shown in FIG. 1. FIG. 3A, FIG. 3B, and FIG. 3C show the same plane structures corresponding to each cell respectively. The projections 30 are formed oppositely each other on the metal sheet 4*a* ((a)), no projection is formed on the metal sheet 4*b* ((b)), and the projections 30' are formed oppositely each other on the metal sheet 4*c* ((c)). The projection 30 and the projection 30' are formed so that two projections are formed per one cell oppositely each other and disposed so as to overlap on the first display electrode (Y electrode (Y1, Y2, and Y3)) 2 respectively. The structure of the projections formed oppositely each other allows the line of electric force in one cell to be concentrated at a plurality of points where the projections are disposed, and the line of electric force is distributed symmetrically. As the result, a portion where the electric field intensity increases can be dispersed correspondingly to the line of electric force distribution in one cell, and the display discharging can be caused at a plurality of places that are located symmetrically. The withstand voltage of an electrode is also improved.

A structure having the projections 30' formed on the metal sheet 4*c* disposed near the first display electrode (Y electrode) and the projections 30 on the metal sheet 4*a* disposed near the second display electrode (X electrode) respectively is described in the above-mentioned exemplary structure. However otherwise, another structure having the projection on the metal sheet 4*b* instead of the metal sheets 4*a* and 4*c* may be employed. Though the projection 30 is formed so as to overlap on the projection 30' vertically and formed at the center position of a cell, the projection maybe formed on different position to avoid vertical overlapping between the lattice-like portion of the lattice-like metal sheet 4*a* and the lattice-like portion of the lattice-like bus electrode 3*b* of the second display electrode (X electrode) According to the above-mentioned first embodiment, the sustain pulse voltage for display discharge can be reduced and the driving power is reduced with simple structure. Furthermore, the luminous efficiency and luminance can be improved.

FIG. 5 to FIG. 8C are diagrams for describing the second example of the present invention.

Figure 5:
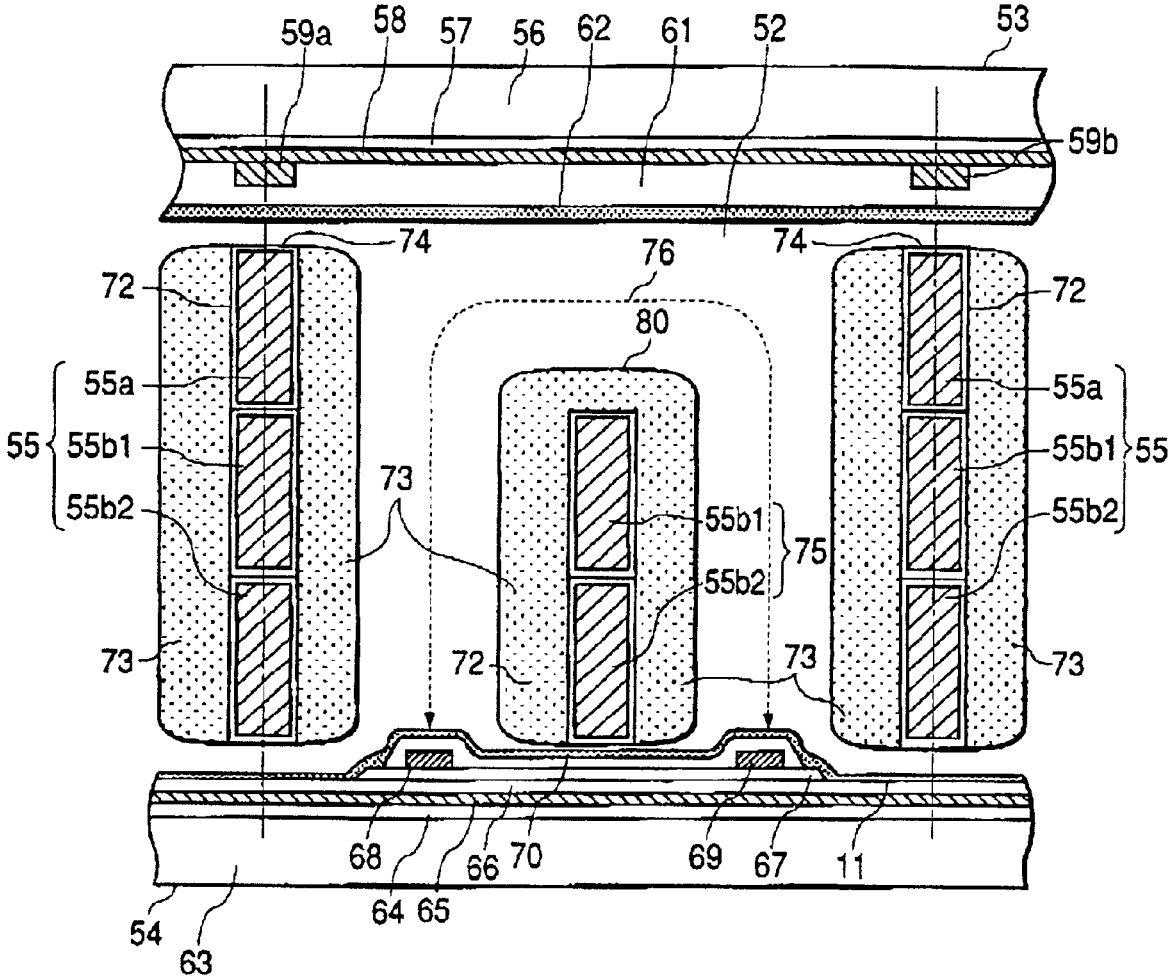
FIG. 5 is a cross sectional view of a plasma display panel in accordance with the second example of the present invention.
Figure 6:
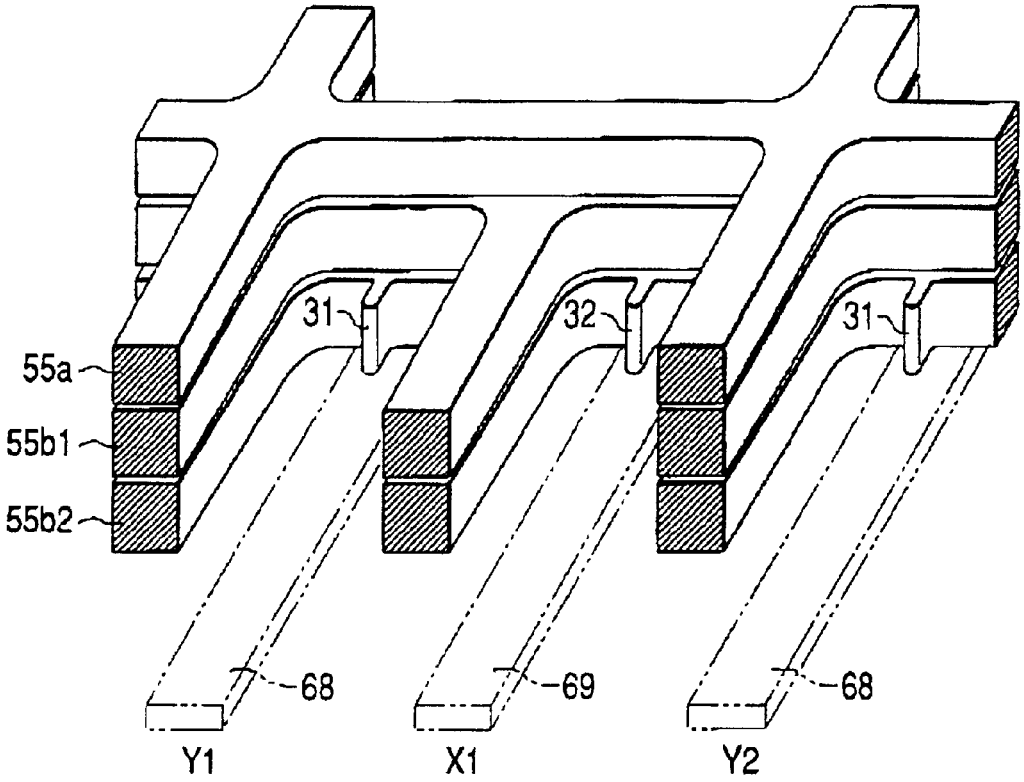
FIG. 6 is a perspective view of an exemplary structure of a metal electrode used in the second example of the present invention.

FIG. 5 is a cross sectional view of a plasma display panel, FIG. 6 is a perspective view of a metal electrode, and FIG. 7 and FIG. 8A to FIG. 8C are plan views of a metal sheet that is a component of the metal electrode.

In the present example, X electrode and Y electrode, which are served as the display electrode, are both disposed on the back substrate side, a barrier plate including a lattice-like metal electrode comprising three metal sheets is provided, a partition wall including a metal electrode of two metal sheets among the three metal sheets is provided, and a reversed U-shaped discharge passage is formed between the X electrode and Y electrode that are served as the display electrode.

In FIG. 5, 65 denotes an address electrode for addressing, 68 denotes a first display electrode (Y electrode) provided so as to cross the address electrode 65 approximately orthogonally served for displaying, 69 denotes a second display electrode (X electrode) disposed approximately parallel to the first display electrode 68 on the approximately same plane as that of the first display electrode 68 served for displaying together with the first display electrode 68, 58 denotes a flat electrode consisting of light emissive material in the form of flat plate, 59*a* and 59*a* denote lattice like bus electrodes overlapped on the flat electrode 58, 74 denotes a lattice-like barrier plate disposed between the side on which the first display electrode (Y electrode) 68 and the second display electrode (X electrode) 69 are disposed and the side on which the flat electrode 58 and bus electrodes 59*a* and 59*b*, 80 denotes a partition wall disposed at the middle of the barrier plate 74, 55 denotes a metal electrode included in the barrier plate 74, 75 denotes a metal electrode included in the partition wall 80, 55*a*, 55*b*1, and 55*b*2 denote metal sheets that are component of these metal electrodes 55 and 75, 63 denotes a back glass substrate, 54 denotes a back substrate, 53 denotes a front substrate, 56 denotes a front glass substrate, 61, 66, 67, and 70 denote dielectric layers, 11 denotes a protection layer consisting of MgO, $Y_2O_3$, or $RuO_2$, 72 denotes an oxide film, 73 and 62 denote fluorescent layers, 52 denotes a display cell, 57 and 64 denote under layer films, and 76 denotes a discharge passage. The above-mentioned address electrode 65, first display electrode (Y electrode) 68, and second display electrode (X electrode) 69 are structured so that a positive or negative voltage is applied on these electrodes respectively, and the metal sheet 55*b*2 is grounded for zero potential. The metal sheet 55*a*, metal sheets 55*b*1 and 55*b*2 are different in type. As described here in above, by disposing the partition plate 80 that is lower than the barrier wall 74 at the middle of the barrier wall 74, the U-shaped discharge passage 76 that continues from the first display electrode 68 to the second display electrode 69 is formed. The length of the discharge passage is significantly longer in comparison with the case in which the first display electrode 68 and the second display electrode 69 are disposed flat on the front substrate 53 side or with the case in which the first display electrode 68 and the second display electrode 69 are disposed separately on the front substrate 53 side and the back substrate 54 side so as to face each other. In such structure, address operation is performed by applying a voltage on the address electrode 65 and the first display electrode (Y electrode) 68 respectively, and display operation is performed by applying a voltage on the first display electrode (Y electrode) 68 and second display electrode (X electrode) 69 respectively.

FIG. 6 is a diagram showing an exemplary structure of the metal electrodes 55 and 75 shown in FIG. 5. A lattice-like portion is enlarged. Three metal sheets 55*a*, 55*b*1, and 55*b*2 are laminated, the metal sheet 55*a* among these metal sheets 55*a*, 55*b*1, and 55*b*2 forms the barrier plate 55 and the metal sheets 55*b*1 and 55*b*2 form the barrier plate 55 and the partition wall 75 both. A projection 31 that projects toward the cell space side is formed on the metal sheet 55*b*2 located adjacent to the first display electrode (Y electrode) 68 and the second display electrode (X electrode) 69 disposed on the back substrate 54 side at the position where the first display electrode (Y electrode) 68 overlaps flat with the metal sheet 55*b*2 (in the longitudinal direction of the first display electrode (Y electrode) 2). On the other hand, a projection 32 that projects towards the cell space side is formed on the metal sheet 55*b*2 located adjacent to the first display electrode (Y electrode) 68 and the second display electrode (X electrode) 69 disposed on the back substrate 54 side at the position where the second display electrode (X electrode) 69 overlaps flat with the metal sheet 55*b*2 (in the longitudinal direction of the second display element (X electrode) 69). The projections 31 and 32 are disposed so as to face each other in the form of a pair in one cell. The projection 31 provided in the above-mentioned structure concentrates the line of electric force formed between the first display electrode (Y electrode) 68 and the projection 31 when a sustain pulse voltage is applied on the first display electrode (Y electrode) 68 to thereby intensify the line of electric force density, and the electric field intensity is increased resultantly. The increased electric field intensity brings about easy display discharge. In other words, the electric field intensity required for display discharge is secured with a low voltage, and the sustain pulse voltage to be applied on the first display electrode (Y electrode) 68 can be reduced. The projection 32 concentrates the line of electric force formed between the second display electrode (X electrode) and the projection 32 to thereby intensify the line of electric force density when a sustain pulse voltage is applied on the second display electrode (X electrode) 69 to thereby intensify the line of electric force density, and the electric field intensity is increased. The increased electric field intensity brings about easy display discharge. In other words, the electric field intensity required for display discharge is secured with a low voltage, and the sustain pulse voltage to be applied on the second display electrode (X electrode) 69 can be reduced.

Figure 7:
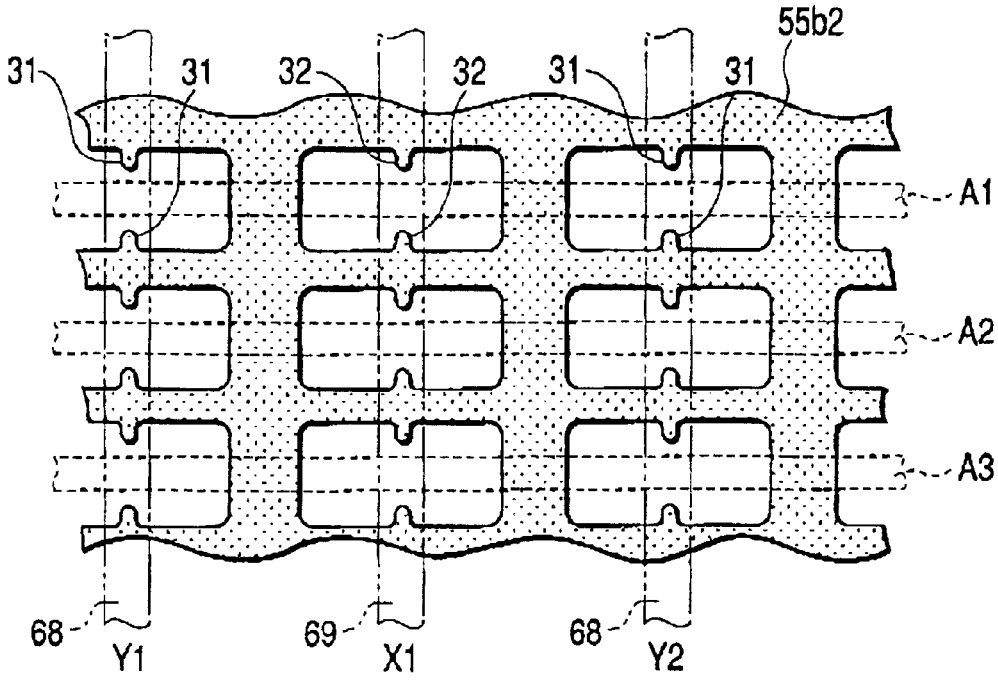
FIG. 7 is a plan view showing a metal sheet that is a component of the metal electrode shown in FIG. 6.

FIG. 7 is a plan view of the metal sheet 55*b*2 that is shown in FIG. 6 together with other metal sheets 55*a* and 55*b*1. Two projections 31 and two projections 32 are formed in each cell in the form of pair. A1, A2, and A3 denote address electrodes in FIG. 7.

Figure 8A:
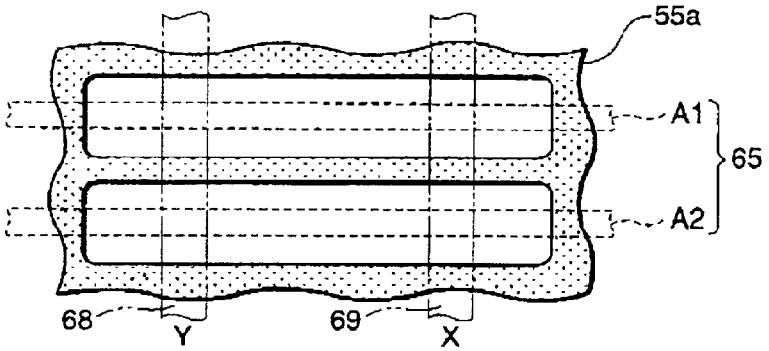
FIG. 8A to FIG. 8C are plan views showing a metal sheet that is a component of the metal electrode shown in FIG. 6.
Figure 8B:
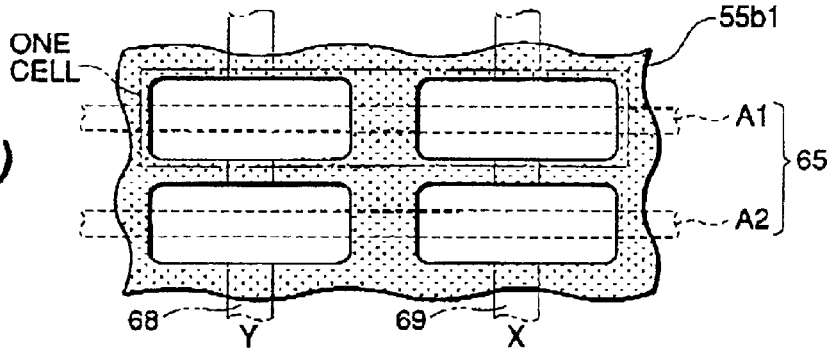
Figure 8C:
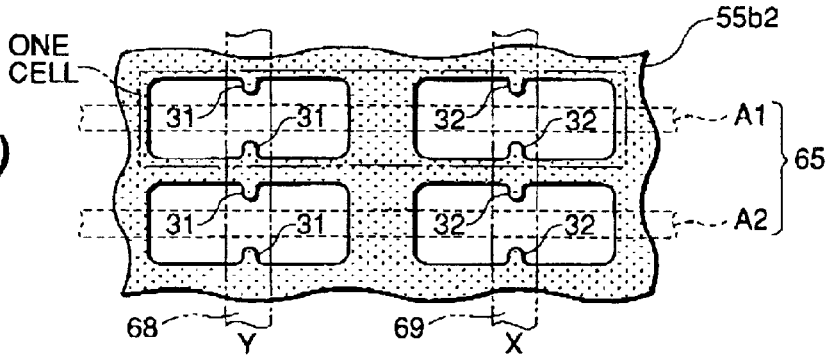

FIG. 8A to FIG. 8C are plan views of the three metal sheets 55*a*, 55*b*1, and 55*b*2 shown in FIG. 6. FIG. 8A, FIG. 8B, and FIG. 8C show the plan structure of the portions corresponding to the same cell. No projection is formed on the metal sheets 55*a* and 55*b*1 ((a) (b)), but projections 31 and 32 are formed per cell of the metal sheet 55*b*2 in the form of pair ((c)) Two projections 31 and 32 are disposed per cell in the form of pair, the projection 31 is formed at the position where the first display electrode (Y electrode) 68 overlaps flat with the metal sheet 55*b*2 on the place located at approximately central position of a lattice. The projection 32 is formed at the position where the second display electrode (X electrode) 69 overlaps flat with the metal sheet 55*b*2 on the place located at approximately central position of a lattice. By disposing the projections in the form of pair, the line of electric force in one cell is concentrated at a plurality of points where the projections are formed and distributed symmetrically as in the case of the above-mentioned first example. As the result, the point where the electric field intensity increases can be dispersed correspondingly to the line of electric force, and the display discharge can be generated approximately symmetrically at a plurality of points. Furthermore, the withstand voltage of an electrode can be improved.

The projections 31 and 32 are formed only on the metal sheet 55*b*2 disposed adjacent to the first display electrode (Y electrode) and the second display electrode (X electrode) in the above-mentioned exemplary structure, but the projections 31 and 32 may be formed on other metal sheet, for example 55*b*1, additionally. According to the above-mentioned second example, the sustain pulse voltage for display discharge can be reduced and the driving power is reduced with simple structure as in the case of the above-mentioned example 1. Furthermore, the luminous efficiency and luminance can be improved.

Figure 9A:
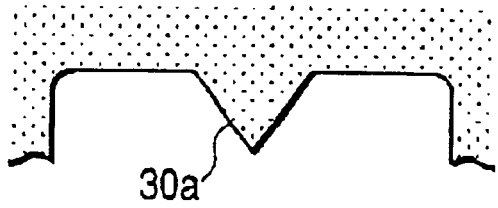
FIG. 9A to FIG. 9E are diagrams showing various configuration of the projection.
Figure 9B:
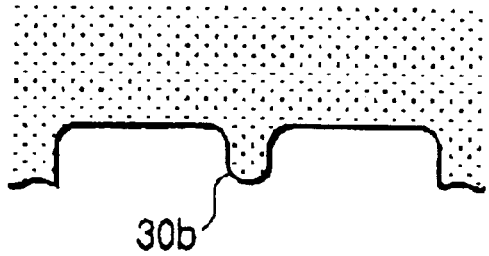
Figure 9C:
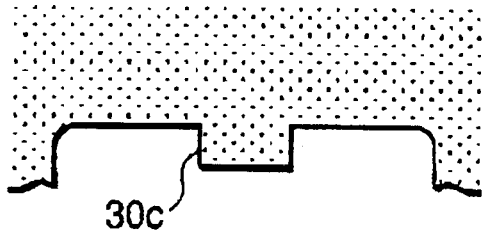
Figure 9D:
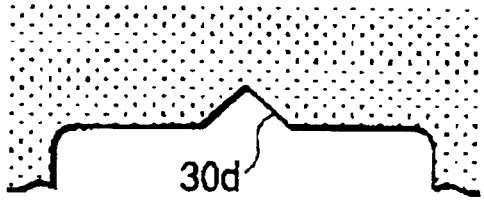
Figure 9E:
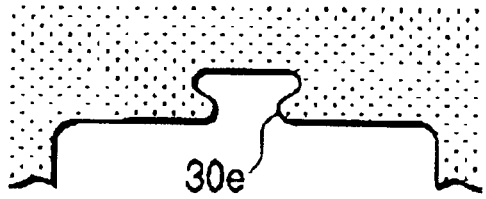

FIG. 9A to FIG. 9E show exemplary configuration of the projection formed on a metal electrode. FIG. 9A shows an exemplary configuration having a tip end, FIG. 9B shows an exemplary configuration having a rounded end, FIG. 9C shows an exemplary configuration having a flat end with some angle, and FIG. 9D and FIG. 9E show exemplary configurations having the projection formed on the opening of a concave. Particularly in the case of the projection shown in FIG. 9B, it is easy to form a film provided on the outside of a metal electrode, for example, dielectric layer or fluorescent layer, having an even thickness, and excessive concentration of the line of electric force at the projection is prevented and the withstand voltage of an electrode can be improved.

Figure 10:
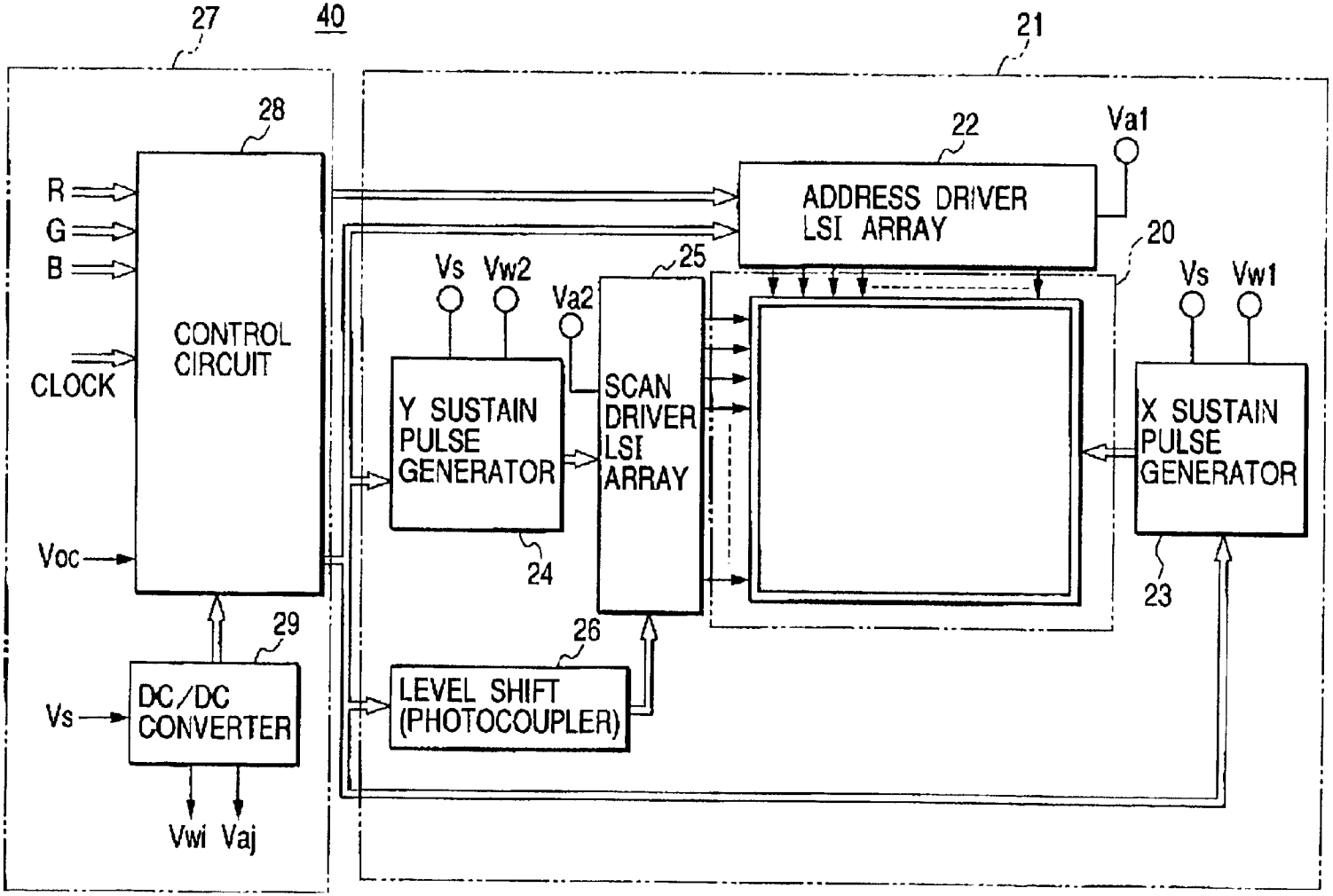
FIG. 10 is a diagram showing an exemplary structure of an image display apparatus shown as an example of the present invention.

FIG. 10 shows an exemplary structure of an image display apparatus of the present invention.

In FIG. 10, 40 denotes an image display apparatus, 20 denotes a plasma display panel provided with a structure as shown in FIG. 4 or FIG. 5, 25 denotes a scan driver LSI (IC) array for scan-driving the first display electrode (Y electrode) of the panel in a sub-field unit, 22 denotes an address driver LSI (IC) array that is served as a first driving circuit for forming the address pulse voltage at the timing corresponding to the image signal and for driving the address electrode by use of the address voltage to address the display cell of the panel in a sub-field unit, 23 denotes an X sustain pulse generator that is served as the second driving circuit for generating a sustain pulse to drive the second display electrode (X electrode), 24 denotes a Y sustain pulse generator that is served as the second driving circuit for generating a sustain pulse to drive the first display electrode (Y electrode), 26 denotes a photocoupler for transmitting a control signal to the scan driver LSI array 25, 21 denotes a panel side apparatus that includes the above-mentioned components, 28 denotes a control circuit served for controlling the scan driver LSI (IC) array, address driver LSI (IC) array, X sustain pulse generator 23, Y sustain pulse generator 24, and photocoupler 26, 29 denotes a DC/DC converter for generating various voltages that are required for forming driving waveform, 27 denotes a control circuit apparatus that includes the control circuit 28 and the DC/DC converter 29.

According to the image display apparatus described hereinabove, the voltage and power consumption for display discharging are reduced. Furthermore, the luminous efficiency and luminance are improved.

The metal electrode that is a component of the barrier plate or partition wall comprises a plurality of metal sheets is used for the above-mentioned plasma display panel example, but the present invention is by no means limited to this structure, the metal electrode may comprises a single metal sheet. Furthermore, the cross section configuration of the metal sheet is by no means limited to the rectangular configuration as shown in the drawing.

The invention that has been accomplished by the inventors is described referring to the embodiments, but the present invention is by no means limited to the above-mentioned embodiments, as a matter of course, the embodiment may be modified variously without departing from the spirit and scope of the invention.

The representative characteristic points disclosed in the above-mentioned examples are listed herein under.

(1) A plasma display panel provided with a barrier plate including a metal electrode disposed between the first and second display electrodes that are formed so as to intersect with the address electrode, wherein the metal electrode has a projection that projects to the cell space side partially in a plane approximately parallel to the panel plane.

(2) The plasma display panel described in (1), wherein the metal electrode has projections that project toward the cell space side partially in a plane approximately parallel to the lattice plane so as to face each other with interposition of the middle of a cell.

(3) The plasma display panel described in (1), wherein the metal electrode has a projection that projects toward the cell space side partially at the position where the metal electrode overlaps flat with any one of the first display electrode and the second display electrode.

(4) The plasma display panel described in (1), wherein the metal electrode has projections that project toward the cell space side partially on the first portion where the metal electrode overlaps flat with the first display electrode and on the second portion where the metal electrode overlaps flat with the second display electrode.

(5) A plasma display panel provided with an address electrode, a first dielectric layer formed on the address electrode, a first electrode formed on the first dielectric layer so as to intersect with the address electrode, a second electrode formed on the surface that faces to the first electrode, and a barrier plate having a metal electrode formed between a first substrate including the first electrode and a second substrate including the second electrode, wherein the metal electrode has a projection or convex at the position where the metal electrode intersects with the first electrode.

(6) The plasma display panel described in (5), wherein the metal electrode comprises a plurality of layers, at least a layer of the metal electrode located near the first electrode has a projection or concave at the position where the metal electrode intersects with the first electrode.

(7) A plasma display panel provided with an address electrode, a first dielectric layer formed on the address electrode, a first electrode and second electrode formed on the first dielectric layer so that the first electrode and the second electrode intersect with the address electrode, a flat electrode formed on the surface that faces to the first electrode and the second electrode, and a barrier plate having a metal electrode formed between a first substrate including the address electrode and a second substrate including the flat electrode, wherein the metal electrode has a projection or concave at least at the position where the metal electrode intersects with the first electrode or the second electrode.

(8) The plasma display panel described in (7), wherein the metal electrode comprises a plurality of layers, and a layer of the metal electrode located near the first electrode and the second electrode has a projection or concave at least at the position where the metal electrode intersects with the first electrode and the second electrode.

(9) The plasma display panel described in (7), wherein the metal electrode comprises a plurality of layers, and a layer of the metal electrode located near the first electrode and the second electrode has a projection or concave at the position where the metal electrode intersects with the first electrode and the second electrode.

(10) The plasma display panel described in (7), wherein the first electrode and the second electrode are formed alternately, and a part of the metal electrode is formed also between the first electrode and the second electrode.

(11) The plasma display panel described in (1), wherein the projections are formed so as to be faced each other.

(12) The plasma display panel described in (5), wherein the projections are formed so as to be faced each other.

(13) The plasma display panel described in (7), wherein the projections are formed so as to be faced each other.

(14) An image display apparatus provided with any one of plasma display panels described in (1) to (13) for displaying an image by driving the plasma display panel based on the image signal.

The present invention includes all the applicable apparatus such as display apparatus used for computers, flat type television, display apparatus for displaying advertisement and other information, and presentation apparatus in the scope of the invention.

According to the present invention, the driving voltage and power consumption to be supplied for displaying can be reduced. Furthermore, the luminous efficiency and luminance are improved.

What is claimed is:

1. A plasma display panel comprising:

a first substrate on which a first electrode is formed;

a second substrate on which a second electrode facing said first substrate is formed;

a barrier plate having a metal electrode and disposed between said first substrate and said second substrate; and a cell defined as a region of space bounded by said first substrate, said second substrate, and said barrier plate, said metal electrode having a projection that is only a portion of said metal electrode which projects into said region of space in a plane approximately parallel to a plane of said plasma display panel.

2. The plasma display panel claimed in claim 1, wherein said projection of said metal electrode is formed at a position where said metal electrode overlies said first electrode.

3. The plasma display panel claimed in claim 1, wherein said metal electrode has another projection which projects into said cell, said projections being formed at opposing surfaces of said barrier plate which form sides of said cell, said projections thereby being in opposed relation to each other.

4. The plasma display panel claimed in claim 1, wherein metal electrode comprises a plurality of layers, at least a first layer of said metal electrode having a projection or a concave at a position where said metal electrode crosses over said first electrode.

5. A plasma display panel comprising:

a first substrate;

a second substrate in facing relation to said first substrate;

a barrier plate disposed between said first substrate and said second substrate and having a metal electrode; and a cell defined by said first substrate and said second substrate and said barrier plate, said first substrate comprising an address electrode, a first dielectric layer formed on said address electrode, a first electrode formed on said first dielectric layer such that said first electrode crosses over said address electrode, said second substrate comprising a second electrode, said metal electrode having a projecting portion at a position where said metal electrode crosses over said first electrode, said projection being directed toward said cell in a plane approximately parallel to said plasma display panel.

6. The plasma display panel claimed in claim 5, wherein said projecting portion is formed at a position where said metal electrode overlaps flat with said first electrode.

7. The plasma display panel claimed in claim 5, wherein said metal electrode has additional projecting portions, said additional projecting portions being formed at opposing surfaces of said barrier plate which form sides of said cell, thereby being in opposed relation to each other.

8. The plasma display panel claimed in claim 6, wherein said metal electrode comprises a plurality of layers, at least a layer of said metal electrode located near said first electrode has a projecting portion at a position where said metal electrode crosses over said first electrode.

9. A plasma display panel comprising:

a front substrate;

a back substrate; and a barrier plate which is formed between said front substrate and said back substrate, said barrier plate configured with a plurality of cells, said back substrate comprising a back glass substrate, an address electrode, an X electrode, and a Y electrode formed thereon, said X electrode and said Y electrode overlying and in crossed relation to said address electrode, said barrier plate comprising a metal electrode having a first projection part which projects into said cell in a plane that is approximately parallel to said display panel and at the position where said metal electrode crosses over said X electrode and a second projection part which projects into said cell in a plane that is approximately parallel to said display panel and at the position where said metal electrode crosses over said Y electrode.

10. The plasma display panel claimed in claim 9, wherein said barrier plate further comprises segment formed between said X electrode and said Y electrode in a manner to define a reversed U-shaped discharge passage between said X electrode id said Y electrode.

11. The plasma display panel claimed in claim 9, wherein said X electrode and said Y electrode are formed alternately and said metal electrode further comprises a segment formed between said X electrode and said Y electrode.

12. A plasma display panel comprising:

a first substrate on which a first electrode is formed;

a second substrate on which a second electrode that facing said first substrate is formed;

a barrier plate having a metal electrode formed between said first substrate and said second substrate; and a cell bounded by said first substrate, said second substrate, and said barrier plate, wherein said metal electrode has a concave portion that projects away from said cell in a plane parallel to a plane of said panel.

13. A plasma display panel comprising:

a first substrate;

a second substrate facing said first substrate;

a barrier plate having a metal electrode formed between said first substrate an said second substrate; and a cell formed among said first substrate, said second substrate, and said barrier plate, wherein said first substrate has an address electrode, a first dielectric layer formed on said address electrode, a first electrode formed on said first dielectric layer so that said first electrode crosses over said address electrode, and said second substrate has a second electrode, wherein said metal electrode has a concave portion which projects in a direction away from said cell and in a plane approximately parallel to a plane of said plasma display panel at a position where said metal electrode crosses over said first electrode.

14. A plasma display panel comprising:

a front substrate;

a back substrate; and a barrier plate which is formed between said front substrate and said back substrate to form a plurality of cells, wherein said front substrate has a front glass substrate having formed thereon an X electrode, wherein said back substrate has a back glass substrate having formed thereon an address electrode and a Y electrode, said barrier plate having a metal electrode having a concave portion that projects opposite to said cells and in a plane approximately parallel to said plasma display panel at a position where said metal electrode crosses over said Y electrode.

15. A plasma display panel comprising:

a first substrate;

a second substrate facing said first substrate; and a barrier plate having a metal electrode formed between said first substrate and said second substrate; and a cell formed among said first substrate, said second substrate, and said barrier plate, wherein said first substrate has an address electrode, a first dielectric layer formed on said address electrode, a first electrode and a second electrode formed on said first dielectric layer so that said first electrode and said second electrode intersect with said address electrode, wherein said metal electrode has a concave portion which projects in a direction away from said cell and in a plane approximately parallel to a plane of said plasma display panel at a position where said metal electrode crosses over at least one of said first electrode and said second electrode.

16. A plasma display panel comprising:

front substrate;

a back substrate; and a barrier plate which is formed between said front substrate and said back substrate to form a plurality of cells, wherein said back substrate has a back glass substrate having formed thereon an address electrode, an X electrode and a Y electrode, said X and Y electrodes intersecting said address electrode, wherein said barrier plate has a metal electrode, said metal electrode has a first concave portion which projects in a direction away from said cell and in a plane approximately parallel to a plane of said plasma display panel at a position where said metal electrode crosses over said X electrode, and a second concave portion which projects in a direction opposite said cell and in a plane approximately parallel to a plane of said plasma display panel at a position where metal electrode crosses over said Y electrode.

* * * * *